US008161947B2

(12) United States Patent
Kuhnke et al.

(10) Patent No.: US 8,161,947 B2
(45) Date of Patent: Apr. 24, 2012

(54) PRESSURE BOOSTING SYSTEM FOR AT LEAST ONE FUEL INJECTOR

(75) Inventors: Dominik Kuhnke, Gerlingen (DE); Dirk Vahle, Vailhingen A.D. Enz/Ot Pulverdin (DE)

(73) Assignee: Robert Bosch GmbH, Stuttgart (DE)

( * ) Notice: Subject to any disclaimer, the term of this patent is extended or adjusted under 35 U.S.C. 154(b) by 336 days.

(21) Appl. No.: 12/599,392

(22) PCT Filed: Apr. 15, 2008

(86) PCT No.: PCT/EP2008/054531
§ 371 (c)(1),
(2), (4) Date: Nov. 9, 2009

(87) PCT Pub. No.: WO2008/135349
PCT Pub. Date: Nov. 13, 2008

(65) Prior Publication Data

US 2010/0212636 A1 Aug. 26, 2010

(30) Foreign Application Priority Data

May 7, 2007 (DE) ..... 10 2007 021 326

(51) Int. Cl.
*F02M 57/02* (2006.01)
*F02M 37/00* (2006.01)

(52) U.S. Cl. ..... 123/511; 123/447; 417/401

(58) Field of Classification Search ..... 123/445, 123/446, 447, 456, 510, 511; 417/392, 397, 417/399, 401
See application file for complete search history.

(56) References Cited

U.S. PATENT DOCUMENTS

| | | | | |
|---|---|---|---|---|
| 3,059,433 | A * | 10/1962 | Hirsch | 60/565 |
| 3,737,254 | A * | 6/1973 | Swatty | 417/403 |
| 4,233,000 | A * | 11/1980 | Cox | 417/402 |
| 5,730,104 | A | 3/1998 | Hafner | |
| 6,283,154 | B1 * | 9/2001 | Rizk et al. | 137/625.65 |
| 6,497,217 | B2 * | 12/2002 | Kojima | 123/456 |
| 6,619,263 | B1 | 9/2003 | Mahr et al. | |
| 7,597,545 | B2 * | 10/2009 | Pedersen et al. | 417/225 |
| 7,726,283 | B2 * | 6/2010 | Vahle | 123/446 |
| 2006/0043209 | A1 * | 3/2006 | Magel | 239/88 |
| 2006/0150954 | A1 * | 7/2006 | Moore | 123/446 |
| 2007/0125338 | A1 | 6/2007 | Kato et al. | |
| 2007/0221178 | A1 | 9/2007 | Feinleib | |
| 2008/0093484 | A1 * | 4/2008 | Stoecklein et al. | 239/585.5 |

FOREIGN PATENT DOCUMENTS

| | | | |
|---|---|---|---|
| DE | 19939422 | A1 | 3/2001 |
| EP | 1536131 | A1 | 6/2005 |
| WO | 2005078271 | A1 | 8/2005 |

* cited by examiner

*Primary Examiner* — Thomas Moulis
(74) *Attorney, Agent, or Firm* — Ronald E. Greigg

(57) ABSTRACT

The invention relates to a pressure boosting system for at least one fuel injector of a high pressure injection system of an internal combustion engine, having a hydraulic pressure booster that is actuated by a control valve. The hydraulic pressure booster is configured with a pressure boosting piston, which comprises a first pressure booster piston part having a first diameter and a second pressure booster piston part having a second diameter, wherein the first diameter is greater than the second diameter. The pressure booster piston is disposed within a hydraulic reservoir chamber, onto which pressure is applied, together with the first pressure booster piston part having the greater diameter, wherein the accumulator chamber in turn is configured within a base body. The base body has a piston guide body for at least one of the pressure booster piston parts. The piston guide body is at least partially surrounded by an annular space, which is part of the hydraulic accumulator chamber.

20 Claims, 7 Drawing Sheets

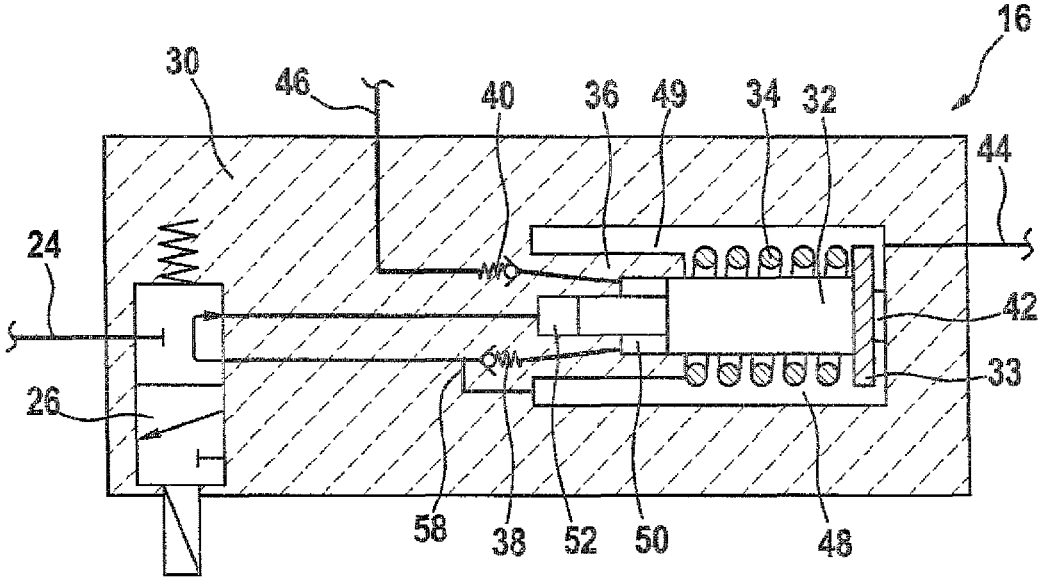
Fig. 3.1
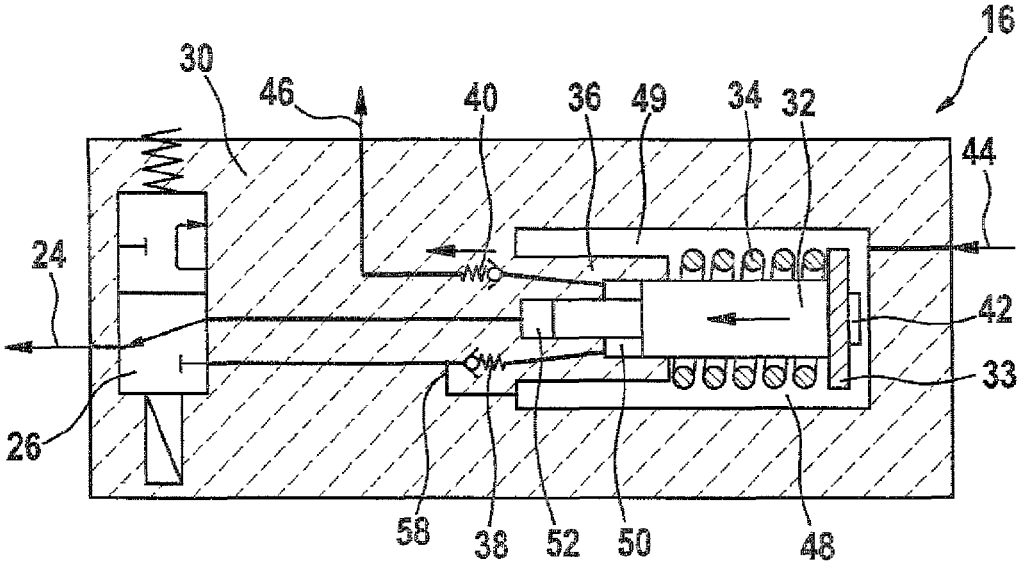
Fig. 3.2

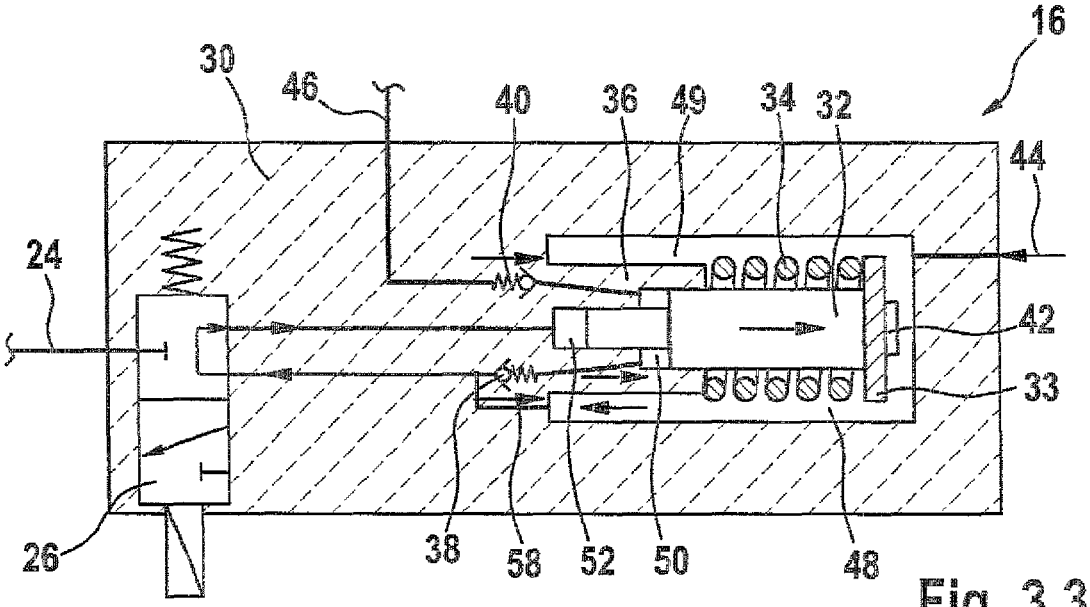
Fig. 3.3
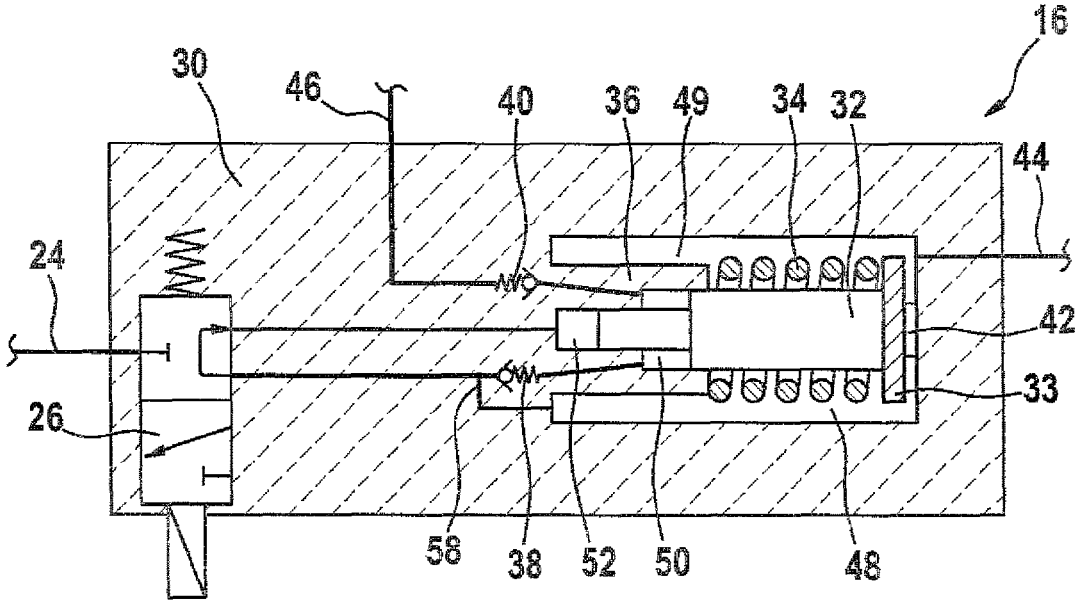
Fig. 3.4

PRESSURE BOOSTING SYSTEM FOR AT LEAST ONE FUEL INJECTOR

CROSS-REFERENCE TO RELATED APPLICATION

This application is a 35 USC 371 application of PCT/EP2008/054531 filed on Apr. 15, 2008.

BACKGROUND OF THE INVENTION

1. Field of the Invention

The invention relates to a pressure boosting system for at least one fuel injector of an internal combustion engine, having a hydraulic pressure booster.

2. Description of the Prior Art

A fuel injection system with pressure boosting, in which one central hydraulic pressure booster is provided for all the fuel injectors, is known from European Patent Disclosure EP 1 125 046 B1. The fuel supplied by means of a high-pressure pump is delivered to a central pressure reservoir (first common rail). The central pressure booster is downstream of the central pressure reservoir in the direction in which the fuel is supplied and carries the pressure-boosted fuel to a further pressure reservoir (second common rail), from which a plurality of pressure lines, corresponding in number to the number of injectors, leads away to the individual fuel injectors. The central pressure booster described in EP 1 125 046 B1, but also the other pressure boosters known, integrated with fuel injectors (as in German Patent Disclosure DE 103 25620 A1), have a pressure booster piston, which has a first piston portion with a first pressure booster piston part having a larger diameter and a second piston portion with a second pressure booster piston part having a small diameter $D_{22}$. The one pressure booster piston part acts upon a high-pressure chamber for pressure boosting, and the other pressure booster piston part acts upon a control chamber or differential pressure chamber that is triggerable by an on-off valve. The pressure booster piston is guided axially movably inside a base body. A pressure face, which is exposed to a work chamber that acts as a hydraulic reservoir chamber and is subjected to the system pressure of the first common rail, is associated with the pressure booster piston on the pressure booster piston part having the larger diameter, on the diametrically opposed face end.

A disadvantage of the known pressure boosting system is the relatively large control quantity for triggering the pressure booster. If for multiple injections of small injection quantities, a boosted injection pressure is required, then the control chamber or differential pressure chamber of the pressure booster must be relieved upon each injection. The result is a large control quantity to be diverted, which must accordingly be included in the lost quantity in the injection system. Multiple injections within the context of a cylinder stroke motion are possible chronologically only within a narrowly defined window as well, since with each triggering of the pressure booster, its differential pressure chamber must refill with fuel. Moreover, with increasing injection pressures, the lost quantity increases proportionally to the fourth power by way of the gap width in the guide of the pressure booster piston, which adversely affects the hydraulic efficiency of such fuel injection systems.

OBJECT AND SUMMARY OF THE INVENTION

It is the object of the present invention to minimize the lost quantities that occur from leakage at guide gaps, in order to increase the efficiency of the pressure boosting of the fuel injection system.

The hydraulic pressure booster employed has a piston guide body, embodied on the base body, for at least one of the pressure booster piston parts, which part is at least partly surrounded by an annular chamber that in turn is part of the hydraulic reservoir chamber. Thus the same pressure prevails in the annular chamber as in the hydraulic reservoir chamber. Because of the surrounding annular chamber, particularly in the pressure boosting state, a supporting pressure exerted from outside is imparted to the piston guide body, as a result of which internal piston guides open less widely or are not widened as much. Consequently, the guide gaps are reduced, and the leakage quantity is minimized. Moreover, as a result, a component load, induced in the guide body, on the differential pressure between the reservoir volume and the high-pressure volume is reduced, so that the effort and expense for high-pressure-proof design and embodiment of the entire hydraulic pressure booster can be lowered. The pressure boosting system according to the invention is moreover optimized in terms of the installation space required for individual system components. Overall, a considerable increase in the total efficiency of the pressure boosting system is achieved.

Advantageous refinements of the invention are possible by means of the provisions of the dependent claims.

In a first expedient embodiment, the first pressure booster piston part having the larger diameter $D_{21}$ acts upon the high-pressure chamber provided for the pressure boosting, and the second pressure booster piston part having the smaller diameter $D_{22}$ acts upon the control chamber, and the first pressure booster piston part having the larger diameter $D_{21}$ is adjoins the hydraulic reservoir chamber. In a variant embodiment, the high-pressure chamber is disposed inside the piston guide body. In another variant embodiment, the high-pressure chamber is defined by a spring-impinged high-pressure sleeve, which is guided axially movably on the pressure booster piston and is positioned against the piston guide body at a sealing point. The diameter of the sealing point is less than or equal to a diameter $D_{21}$ of the first pressure booster piston part. In these embodiments, the control chamber of the pressure booster is embodied inside the piston guide body and is subjected to pressure by the second pressure booster piston part having the smaller diameter $D_{22}$.

A second embodiment provides for transposing the control chamber and the high-pressure chamber; in that case, the second pressure booster piston part having the smaller diameter $D_{22}$ acts upon the high-pressure chamber provided for the pressure boosting, and the first pressure booster piston part having the larger diameter $D_{21}$ acts upon the control chamber. The high-pressure chamber is embodied inside the piston guide body. The control chamber, on which the pressure booster piston part having the larger diameter $D_{21}$ acts, then adjoins the hydraulic reservoir chamber.

It is especially advantageous that the pressure booster is provided centrally for a plurality of fuel injectors and is disposed between a high-pressure pump and a high-pressure reservoir. Because of a modular construction of the high-pressure pump, pressure booster, high-pressure reservoir, and fuel injector, this kind of central pressure booster can be used in all known installation spaces of internal combustion engines. Because of the disposition of the central hydraulic pressure booster between the high-pressure pump and the high-pressure reservoir (common rail), the central pressure booster has to be triggered only once per injection cycle of a fuel injector. As a result, the control quantity and the leakage quantity are reduced considerably, as a function of the number of injections. Because of this circumstance, the high-pressure pump can be embodied with smaller dimensions as well, since less fuel has to be supplied, because the number of refilling phases of the control chamber of the central hydraulic pressure booster is reduced considerably. The central pressure booster can as a result be designed in terms of its high-pressure supply quantity for the maximum possible injection quantity of at least one fuel injector.

It is moreover expedient if the hydraulic reservoir chamber is filled directly with fuel by the high-pressure pump via a high-pressure inlet. The base body, in which the hydraulic reservoir chamber is embodied, can be constructed in one part or multiple parts. The volume of the hydraulic reservoir chamber should be designed such that the pressure drop when fuel is withdrawn is reduced, and the pressure fluctuations from pump supply are damped to an amount that is tolerable for the pressure boosting.

From the high-pressure chamber of the central pressure booster, at least one bore leads to at least one filling valve. The filling valve communicates in turn with the hydraulic reservoir chamber via a bore. From the reservoir chamber, at least one connecting bore leads to a valve and from there to the control chamber. From the high-pressure chamber, there is at least one hydraulic communication with a high-pressure valve, from which at least one outlet extends to the high-pressure reservoir.

The pressure booster piston is acted upon by a restoring spring, which returns it to its outset position so that it rests with one end against a stop. The spring force of the restoring spring is designed such that after the pressure boosting, the high-pressure piston of the central pressure booster is brought back to its outset position at the stop at sufficiently high speed.

At injection pressures below the maximum supply pressure of the high-pressure pump, in a first switching position of an on-off valve, the pressure in the reservoir chamber is built up further by the high-pressure pump via the inflow through check valves via the high-pressure outflow to the high-pressure reservoir. From there, the fuel reaches the fuel injectors. During this mode of operation, the pressure booster is not triggered, so that the fuel supplied by the high-pressure pump reaches the high-pressure reservoir (common rail) in the bypass mode of the pressure booster.

If injection pressures that are above the maximum supply pressure of the high-pressure pump are required, then the pressure booster should be triggered. To that end, the on-off valve, which is a 3/2-way valve, is put in a second switching position, actuated electrically, hydraulically, or pneumatically. In this second switching position, the control chamber of the pressure booster communicates for pressure relief with a pressure booster return via the on-off valve.

BRIEF DESCRIPTION OF THE DRAWINGS

The invention will be described in further detail below in conjunction with the drawings, in which:

FIG. 3.1 shows the outset position of the hydraulic pressure booster of FIG. 2;

FIG. 3.2 shows the pressure boosting phase of the hydraulic pressure booster of FIG. 2;

FIG. 3.3 shows a refilling phase of the hydraulic pressure booster, proposed according to the invention, of FIG. 2;

FIG. 3.4 shows the outset position of the hydraulic pressure booster, proposed according to the invention, of FIG. 2;

DESCRIPTION OF THE PREFERRED EMBODIMENTS

Figure 1:
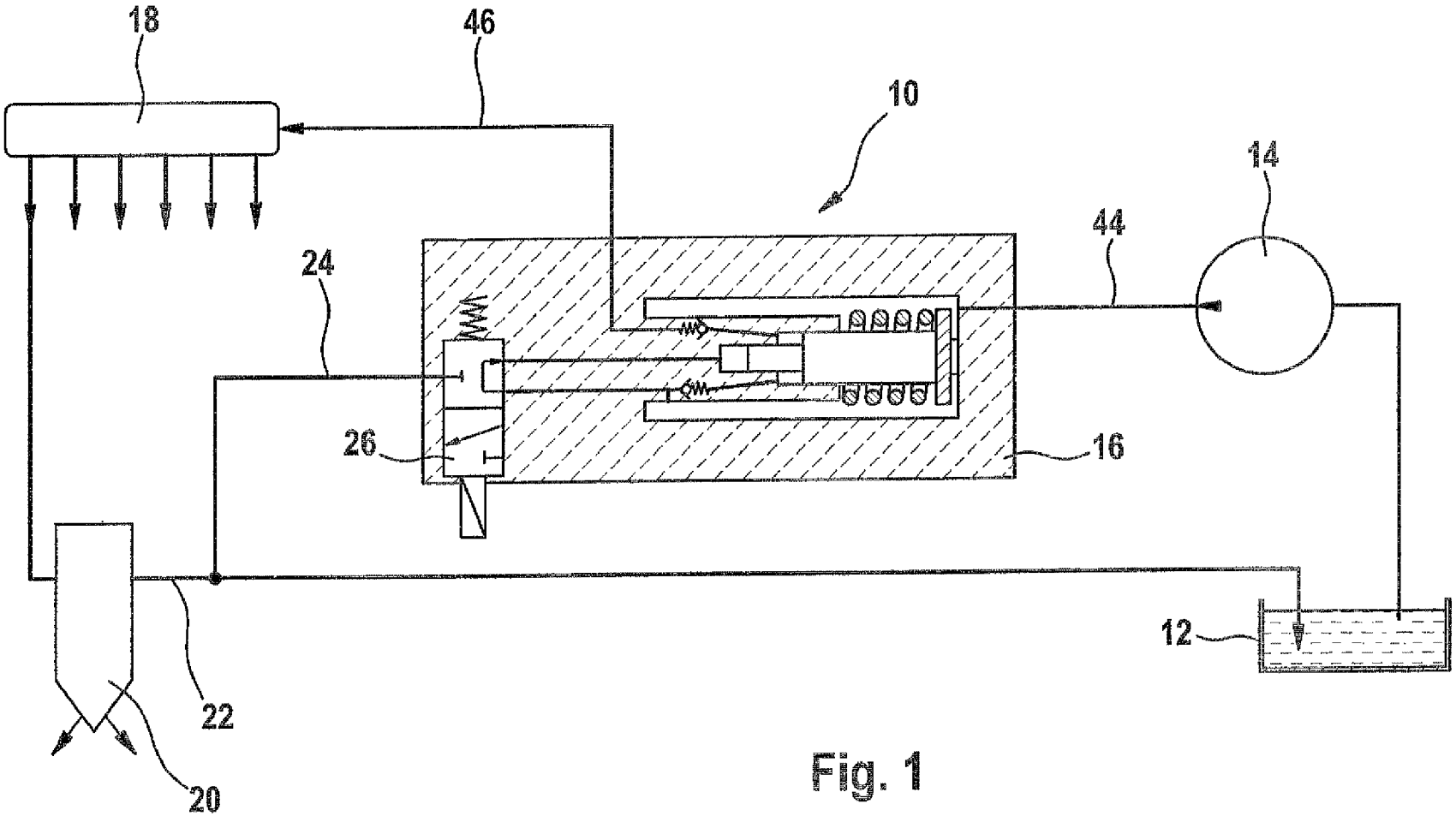
FIG. 1 shows a system layout of a fuel injection system having a central hydraulic pressure booster.

The fuel injection system shown in FIG. 1 has a modular construction of a high-pressure injection system 10, which can be applied for instance to all the installation spaces of internal combustion engines. The high-pressure injection system 10 includes a fuel tank 12, from which fuel is supplied via a high-pressure pump 14 and directed to a hydraulic pressure booster 16. On the one hand, the hydraulic pressure booster 16 communicates via a pressure booster inlet 44 with the aforementioned high-pressure pump 14, and on the other, it acts upon a high-pressure reservoir 18 (common rail). Connection lines, shown only schematically in FIG. 1 and corresponding in number to the number of fuel injectors to be supplied with fuel at system pressure, to fuel injectors 20 are located in the high-pressure reservoir 18. The central hydraulic pressure booster 16 thus in FIG. 1 supplies pressure-boosted fuel to all the fuel injectors 20. However, it is also conceivable for the hydraulic pressure booster 16 described below to be integrated in noncentralized fashion with the respective fuel injector 20.

On the end toward the combustion chamber of the fuel injectors, the fuel at high pressure—indicated by the arrows—is injected into the combustion chamber of a self-igniting internal combustion engine. On the return side, at the fuel injector 20, there is an injector return 22 into which a pressure booster return 24, connected to an on-off valve 26, for instance a 3/2-way valve, discharges. Both the pressure booster return 24 and the injector return 22 represent the low-pressure side of the fuel injection system as shown in FIG. 1, in which the diverted quantity, whether it is a control quantity or a leakage quantity, is returned to the fuel tank 12.

Because of the disposition of the central pressure booster 16 between the high-pressure pump 14 and the high-pressure reservoir 18, the pressure booster 16 has to be triggered with the on-off valve 26 only once per injection cycle of a fuel injector 20. As a result, the control or leakage quantity is reduced considerably, as a function of the number of injections. The high-pressure pump 14 does not have to supply as much fuel and can be made smaller. The pressure booster 16 should be designed in terms of its high-pressure supply quantity for the maximum possible injection quantity of at least one of the fuel injectors 20.

Figure 2:
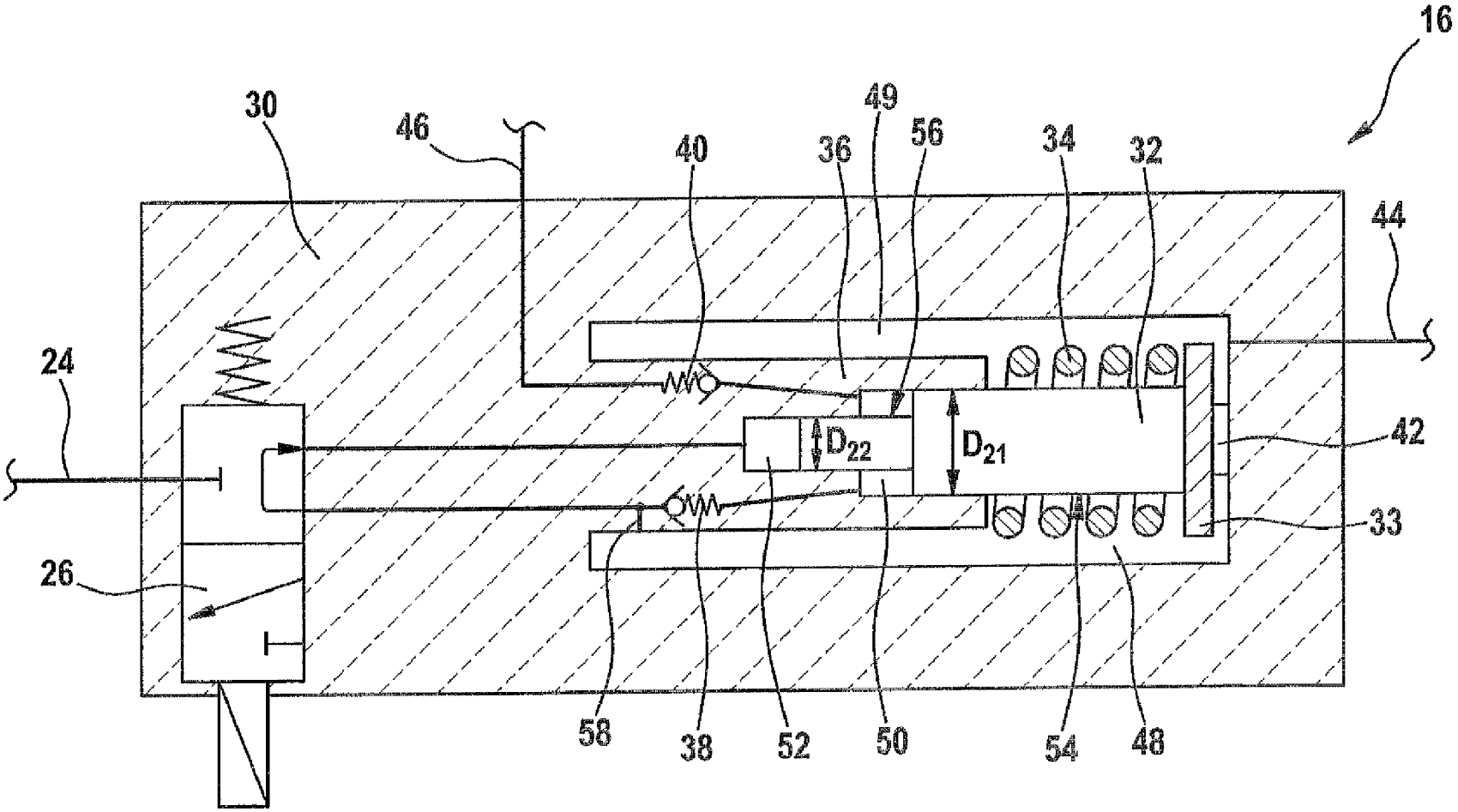
FIG. 2 shows a first exemplary embodiment of a hydraulic pressure booster.

The hydraulic pressure booster 16 in FIG. 2 includes a base body 30, which may be embodied in one part or multiple parts. A hydraulic reservoir chamber 48 is integrated with the base body 30. The hydraulic reservoir chamber 48 is acted upon by fuel from the high-pressure pump 14 via the pressure booster inlet 44. The reservoir volume of the hydraulic reservoir chamber 48 is designed such that the pressure drop is reduced, and pressure fluctuations caused by the pumping by the high-pressure pump 14 can be damped to an amount that is tolerable for the pressure boosting.

The central pressure booster 16 furthermore includes a pressure booster piston 32. It in turn includes a first piston portion with a first pressure booster piston part 54, designed with a diameter $D_{21}$, and a second piston portion with a second pressure booster piston part 56, designed with a diameter $D_{22}$. The pressure booster 16 furthermore includes a high-pressure chamber 50 for pressure boosting and a control chamber 52, which latter can also be called a differential pressure chamber. A piston guide body 36 that is surrounded by an annular chamber 49 is embodied on the base body 30. In the exemplary embodiment of FIG. 2, the first pressure booster piston part 54 having the diameter $D_{21}$ and the second pressure booster piston part 56 having the diameter $D_{22}$ are guided axially movably in the piston guide body 36. The annular chamber 49 is part of the hydraulic reservoir chamber 48 and extends axially along the guide length for the pressure booster piston 32 inside the base body 30. As a result, the pressure prevailing in the hydraulic reservoir chamber 48 acts from outside upon the piston guide body 36. Compared to the boosted pressure in the high-pressure chamber 50 and to the low pressure prevailing in the control chamber 52, the pressure that prevails in the hydraulic reservoir chamber 48 and is furnished by the high-pressure pump 14 is an average pressure, which is established upon triggering of the control chamber 52 as a result of the diversion of the control quantity via the pressure booster return 24.

The pressure boosting ratio i of the pressure booster 16 in the basic sketch shown in FIG. 2 is as follows:

$$i=D_{21}^2/(D_{21}^2-D_{22}^2).$$

In the exemplary embodiments of FIGS. 1 and 2 as well as 5 and 6, the pressure booster piston 32 acts upon the high-pressure chamber 50 with a first pressure face on the first pressure booster piston part 54 having the larger diameter $D_{21}$, and upon the control chamber 52 with a second pressure face on the second pressure booster piston part 56 having the smaller diameter $D_{22}$. In the exemplary embodiment of FIG. 4, the situation is reversed. There, with its first pressure face on the first pressure booster piston part 54 having the larger diameter $D_{21}$, the pressure booster piston 32 acts upon the control chamber 52 and, with a second pressure face on the second pressure booster piston part 56 having the smaller diameter $D_{22}$, it acts upon the high-pressure chamber 50.

The pressure booster piston 32 is acted upon by a restoring spring 34, which is braced on one end on the piston guide body 36 and on the other on a collar 33 embodied on the first pressure booster piston part 54. The pressure booster piston 32, restoring spring 34 and piston guide body 36 are disposed in turn in the reservoir chamber 48 in such a way that the reservoir chamber surrounds the piston guide body 36 in the region of the guide of the pressure booster piston 32, expediently in the region of the first pressure booster piston part 54 embodied with the diameter $D_{21}$. By this provision, the guides of the pressure booster piston 32 are acted upon by a supporting pressure from outside at the instant of the pressure boosting. This supporting pressure from outside causes the guide play, which is increased because of the pressure prevailing in the interior of the pressure booster 16, to widen less; otherwise, the result would be an unwanted outflow of guide leakage, which in turn would adversely affect the hydraulic efficiency of the pressure booster 16.

From the high-pressure chamber 50, a high-pressure outlet 46 branches off, which extends to the high-pressure reservoir 18 (common rail). A high-pressure valve 40, which is embodied as a check valve and prevents a return flow of fuel to the pressure booster 16, is located in the high-pressure outlet 46. From the high-pressure chamber 50 of the high-pressure booster 16, a line that receives a filling valve 38, by way of which valve the high-pressure chamber 50 is refilled with fuel via a filling line 58, also extends from the reservoir chamber 48 to the on-off valve 26. A further line connects a further connection of the on-off valve 26 to the control chamber 52. In the switching position shown in FIG. 2 for the on-off valve 26, the refilling of the control chamber 52 after its pressure relief upon actuation of the on-off valve 26 is effected via the further line, again beginning at the reservoir chamber 48, via the filling line 58.

The restoring spring 34, which is disposed between the guide body 36 and a collar 33 on the pressure booster piston 32, presses the pressure booster piston 32 into its outset position, so that it rests with a stop limitation means 42 on the base body 30. The spring force of the restoring spring 34 is designed such that the pressure booster piston 32, after the pressure boosting, is put back in the outset position at the stop limitation means 42 at an adequately high speed.

At injection pressures below the maximum supply pressure of the high-pressure pump 14, in the first switching position of the on-off valve 26 as shown in FIGS. 1 and 2, the pressure of the high-pressure pump 14 is supplied via the pressure booster inlet 44 into the reservoir chamber 48 and from there onward, via the high-pressure valves 38, 40 embodied as check valves, via the high-pressure outlet 46 to the high-pressure reservoir 18. From there, the fuel reaches the fuel injectors 20 to be supplied with fuel that is at system pressure. The fuel compressed by the high-pressure pump 14 thus in a so-called bypass mode flows from the high-pressure pump 14 directly to the high-pressure reservoir 18 (common rail); that is, in this mode of operation, the pressure booster 16 is not active.

To achieve injection pressures above the maximum supply pressure of the high-pressure pump 14, the pressure booster 16 must be triggered. To that end, the on-off valve 26 is brought electrically, hydraulically or pneumatically into a second switching position. In that switching position of the on-off valve 26, the control chamber 52 is made to communicate with the pressure booster return 24. Fuel flows out of the pressure-relieved control chamber 52 via the on-off valve 26 into the pressure booster return 24 and from there into the low-pressure region of the fuel injection system shown in FIG. 1, back into the fuel tank 12. Because of the pressure reduction in the control chamber 52, the pressure booster piston 32 is moved axially counter to the spring force of the restoring spring 34, so that the first pressure booster piston part 54, embodied with the diameter $D_{21}$, presses into the high-pressure chamber 50 and increases the pressure there. The filling valve 38 in turn is closed in the direction of the pressure booster return 24. If the pressure then increases in the high-pressure chamber 50 to above the pressure on the side of the high-pressure outlet 46, the compressed fuel is pumped farther into the high-pressure reservoir 18 (common rail) by the high-pressure valve 40. The high-pressure reservoir 18 is thus filled with the elevated pressure from the high-pressure chamber 50. From there, the fuel injectors 20 are then acted upon by the elevated fuel pressure, so that the injection via the fuel injectors is effected at the fuel pressure that is above the supply pressure of the high-pressure pump 14. The pressure in the high-pressure chamber 50 rises until such time as a force equilibrium is again established at the pressure booster piston 32.

Upon deactivation of the on-off valve 26, the control chamber 52 again communicates hydraulically with the reservoir chamber 48. Because of this hydraulic communication, the pressure in the control chamber 52 rises, and the pressure booster piston 32 terminates the process of pressure boosting in accordance with the pressure boosting ratio i in the high-pressure chamber 50. Simultaneously, the high-pressure valve 40 also closes, because of the existing pressure difference. The spring force of the restoring spring 34 now presses the pressure booster piston 32, with the stop limitation means 42, against the base body 30 of the pressure booster 16. During this period of time, fuel is aspirated from the reservoir chamber 48 into the high-pressure chamber 50 via the filling valve 48. Once the pressure booster piston 32 reaches the stop limitation means 42, the on-off valve 26 can be triggered for renewed pressure boosting. Although renewed triggering is possible before the stop limitation means 42 is reached, it would not be appropriate because of what is then a still-indefinite restoration position of the pressure booster piston 32 having a first pressure booster piston part 54 and a second pressure booster piston part 56.

The sequence of FIGS. 3.1 through 3.4 shows the phases in operation of the pressure booster 16 of FIG. 2, namely the outset position, pressure boosting, refilling phase, and again the outset position. In FIG. 3.1, the reservoir chamber 48 in the base body 30 is subjected to fuel under pressure via the pressure booster inlet 44. The pressure that prevails in the reservoir chamber 48 prevails both in the control chamber 52, via the filling line 58, and in the high-pressure chamber 50, via the filling valve 38. In the outset position shown in FIG. 3.1, the pressure booster 16 is not activated by the on-off valve 26. As FIG. 3.1 shows, because of the switching position of the on-off valve 26, the reservoir chamber 48 and the control chamber 52 are short-circuited.

FIG. 3.2 shows the ensuing activation of the pressure booster 16 during a pressure boosting operation. To that end, current is supplied to the on-off valve 26, and the control chamber 52 is made to communicate with the pressure booster return 24, that is, the low-pressure region of the fuel injection system 10. Because of the pressure relief of the control chamber 52, the second pressure booster piston part 56 moves into the control chamber 52, so that the fuel kept on hand in the high-pressure chamber 50 is compressed by further movement inward of the pressure booster piston 32, and in particular of its first pressure booster piston part 54. The maximum pressure prevailing in the high-pressure chamber 50 is diverted via the high-pressure valve 40 into the high-pressure outlet 46, and from there it reaches the high-pressure reservoir 18 (common rail), not shown in FIG. 3.2. An outflow of fuel from the high-pressure chamber 50 is not possible counter to the direction of action of the filling valve 38. The latter blocks in the direction of medium pressure, while the connection geometry at the on-off valve 26 shown in FIG. 3.2 blocks in the direction of low pressure.

FIG. 3.3, by comparison, shows a refilling phase of the pressure booster, in which the on-off valve 26 is switched back into its switching position shown in FIG. 3.1. From FIG. 3.3, it can be seen that the reservoir chamber 48, via the pressure booster inlet 44, is subjected continuously to fuel under pressure which is precompressed in accordance with the pressure level of the high-pressure pump 14. The fuel kept on hand in the reservoir chamber 48 flows via the filling line 58 and the on-off valve 26 both to the control chamber 52, filling it, and to the high-pressure chamber via the filling valve 38, so the high-pressure chamber is likewise replenished with fuel. Because of the action of the restoring spring 34, which is braced on one end on the piston guide body 36 and on the other on the collar 33 of the pressure booster piston 32, the pressure booster piston 32, with its first pressure booster piston part 54 and its second pressure booster piston part 56, returns to its outset position shown in FIG. 3.4 again, in which the stop limitation means 42 touches the inside of the base body 30.

In the outset position shown in FIG. 3.4, the same pressure and stroke conditions prevail as have already been described in conjunction with the outset position of the pressure booster 16 shown in FIG. 3.1, so that further remarks on this are unnecessary.

Figure 4:
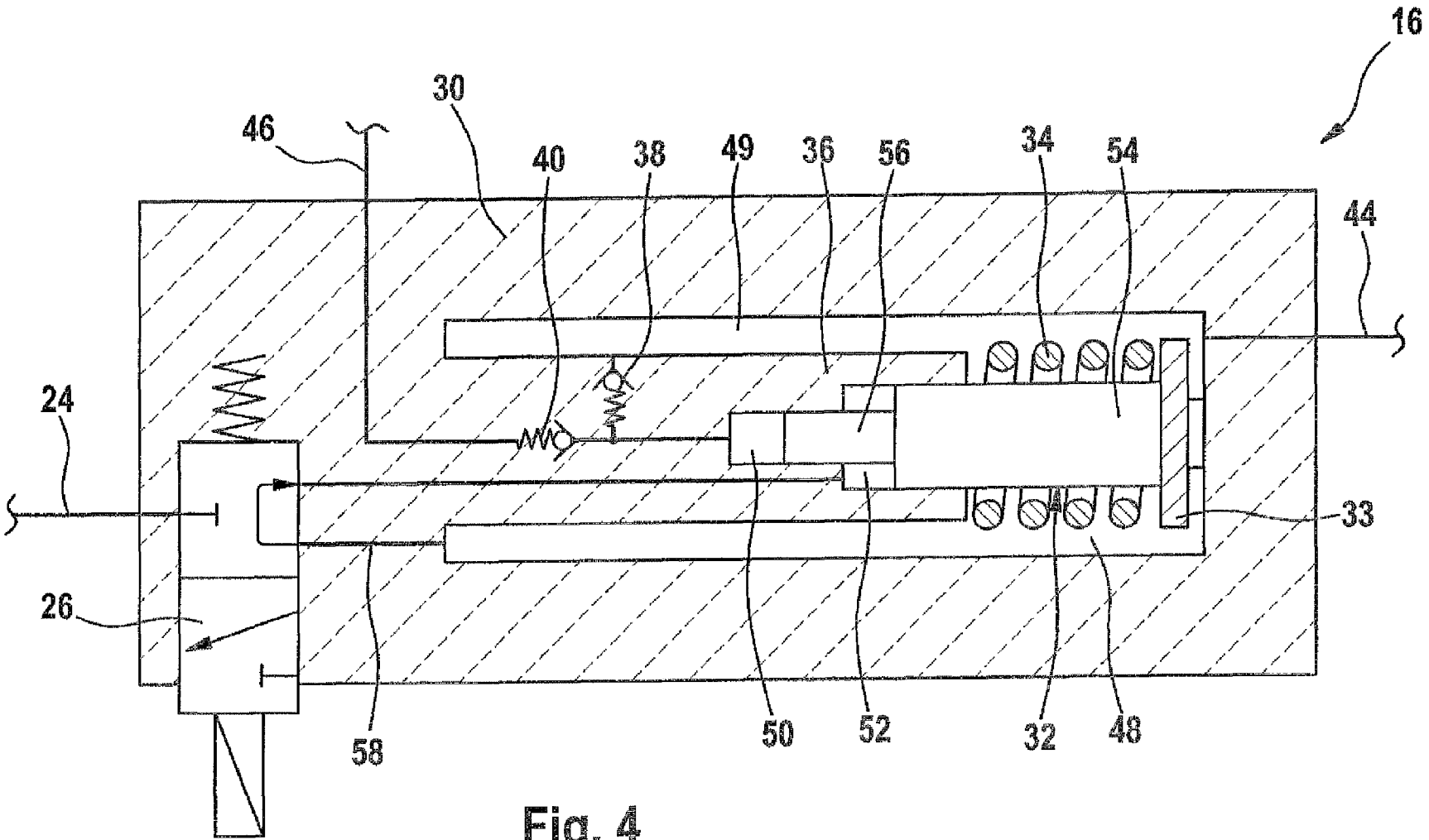
FIG. 4 shows a second exemplary embodiment of the hydraulic pressure booster.

In the illustration in FIG. 4, an embodiment with transposed control and high-pressure chambers can be seen. FIG. 4 shows that in this embodiment, the pressure booster 16 includes the base body 30, in which the piston guide body 36 is embodied. The reservoir chamber 48, which via the pressure booster inlet 44 is subjected by the high-pressure pump 14 shown in FIG. 1 to pressure that is below the maximum pressure level of the this pump, is embodied in the base body 30. The pressure booster piston 32 is also located in the reservoir chamber 48, and the collar 33 on which the restoring spring 34 is braced is embodied on this piston. The restoring spring 34 is braced on its other end on an annular face of the piston guide body 36.

In a distinction from the embodiment of the pressure booster 16 shown in FIG. 2, in the embodiment of FIG. 4 the high-pressure chamber 50 is defined by the second pressure booster piston part 56 having the small diameter $D_{22}$, while the control chamber 52 is defined by the first pressure booster piston part 54 of the pressure booster piston 32 having the larger diameter $D_{21}$. As a result of this change in comparison to the embodiment of FIG. 2, an altered pressure boosting ratio i results, in accordance with the following equation:

$$i=(D_{21}/D_{22})^2.$$

In this embodiment, the number of leakage points toward the low pressure at the pressure booster piston 32 is higher. At the instant of pressure boosting, as shown in FIG. 3.2, there are two leakage points on the guides, from high pressure and medium pressure to return pressure level.

In this embodiment of the pressure booster with transposed control and pressure chambers 52 and 50, respectively, in each case referred to the embodiment of FIG. 2, refilling of the control chamber 52 is effected through the reservoir chamber 48, the filling line 58, and the short circuit at the on-off valve 26, while refilling of the high-pressure chamber designated by reference numeral 50 is effected through the filling valve 38 from the reservoir chamber 48. For the sake of completeness, it should be noted that in this embodiment of the pressure booster 16 as well, the high-pressure outlet is indicated by reference numeral 46, and the pressure booster return associated with the on-off valve 26 is identified by reference numeral 24.

Figure 5:
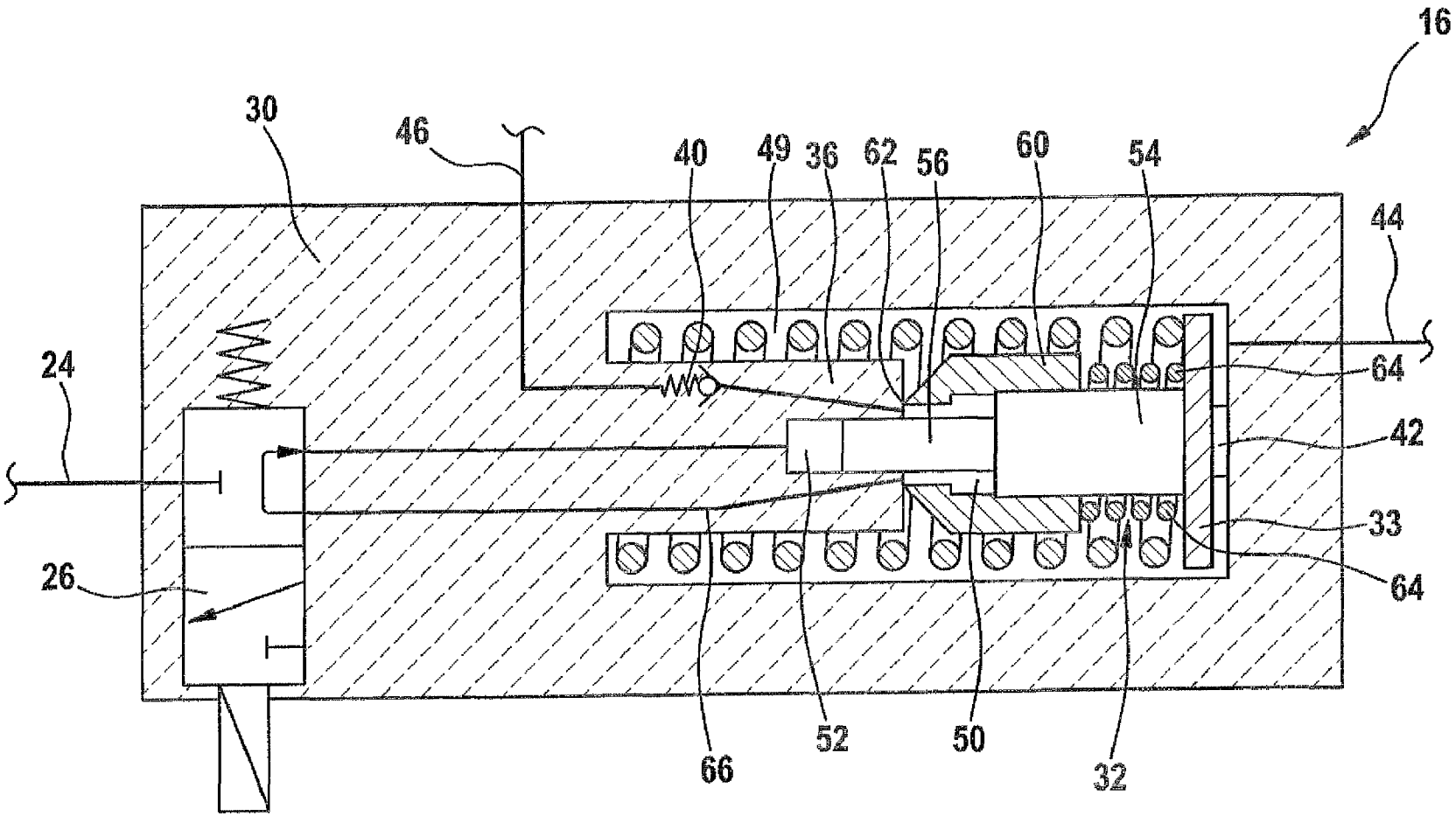
FIG. 5 shows a third exemplary embodiment of the hydraulic pressure booster.

FIG. 5 shows a further exemplary embodiment of the pressure booster 16, in which the high-pressure chamber 50 is defined by a high-pressure sleeve 60. In a distinction from the embodiments of the pressure booster 16 show in FIGS. 2 and 4, in which the high-pressure chamber 50 is defined by the piston guide body 36, in the embodiment of the pressure booster 16 shown in FIG. 5 the high-pressure chamber 50 is defined by a high-pressure sleeve 60 received on the first pressure booster piston part 54. The high-pressure sleeve 60 is acted upon by a prestressing spring 64. This spring, like the restoring spring 34, is braced on the collar 33 of the first pressure booster piston part 54 of the pressure booster piston 32. By the action of the prestressing spring 64, a bite edge of the high-pressure sleeve 60, foaming a sealing point 62, is positioned against the piston guide body 36. The restoring spring 34, which is braced on the collar 33 of the first pressure booster piston part 54, penetrates the entire reservoir chamber 48 and is braced on the base body 30. The second pressure booster piston part 56 of the pressure booster piston 32 protrudes into the piston guide body 36.

In the exemplary embodiment shown in FIG. 5, the high-pressure sleeve 60 for sealing off the high-pressure chamber 50 via the sealing point 62 additionally takes on the filling function the high-pressure chamber 50. A structural advantage of this variant is the fact that the high-pressure sleeve 60 is guided by the pressure booster piston 32. To that end, the sealing diameter at the sealing point 62 must always be less than or at most the same size as the piston diameter of the first pressure booster piston part 54, or in other words $D_{21}$. So that the high-pressure sleeve 60 will always be kept in a defined outset position, it is acted upon by the prestressing spring 64. The design of the spring force for the prestressing spring 64 should be accomplished as a function of the spring force of the restoring spring 34 and the area of the remaining annular face between the sealing point 62 and the piston diameter of the second pressure booster piston part 56, that is, $D_{22}$. The smaller this remaining annular area is, for the same spring force of the restoring spring 34, the less must the spring force be that is exerted by the prestressing spring 64 on the high-pressure sleeve 60.

The refilling of the control chamber 52 can be effected in this embodiment in principle via the high-pressure chamber 50, which represents a filling line 66, and by the use of the short-circuited position of the on-off valve 26, as shown in FIG. 5. Because of the reciprocating motion of the high-pressure sleeve 60 upon refilling of the high-pressure chamber 50, this sleeve can exert uncontrolled opening and closing motions. If suitable precautions against this are not taken, the result would be high wear at the sealing point 62 and at the guide of the pressure booster piston 32, and this would adversely affect the function of the embodiment of the pressure booster 16. A clean switching function is assured with a suitable adaptation of seat geometry and pressure stage.

For the sake of completeness, it should be noted that the high-pressure valve 40, which in this embodiment is embodied as a check valve, is received in the high-pressure outlet 46, which extends to the high-pressure reservoir 18, not shown in FIG. 5.

Figure 6:
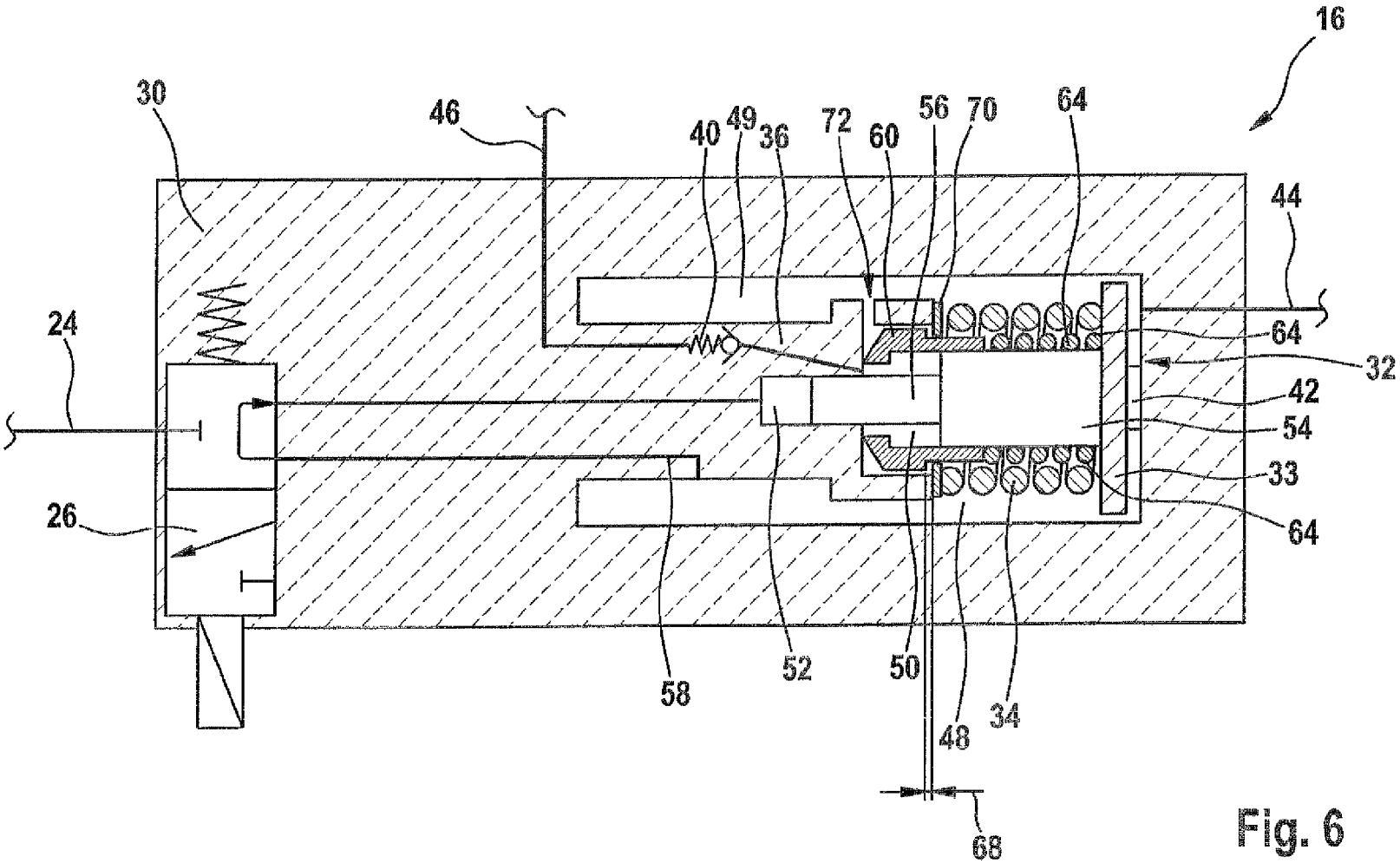
FIG. 6 shows a fourth exemplary embodiment of the hydraulic pressure booster.

In the further exemplary embodiment of the pressure booster 16 shown in FIG. 6, for defining the high-pressure chamber 50, the high-pressure sleeve 60 is again used. It includes an outer indentation which is engaged by a stroke stop element 70 that is fixed on the piston guide body 36 and which thus defines the maximum axial stroke 68 of the high-pressure sleeve 60 relative to the piston guide body 36. Once the high-pressure sleeve 60 has executed its maximum stroke 68, the stroke stop element 70 limits further reciprocating motions. To that end, the stroke stop element 70 is disposed between the restoring spring 34 and the piston guide body 36. The prestressing force of the restoring spring 34 prevents lifting of the stroke stop element 70 from its contact face on the piston guide body 36, which guide body is part of the base body 30 in this embodiment of the pressure booster 16.

So that the refilling of the high-pressure chamber 50 will not be interrupted during the stroke impact of the high-pressure sleeve 60 on the stroke stop element 70, a bypass 72 between the reservoir chamber 48 and the work chamber of the high-pressure sleeve 60 is located on the piston guide body 36. In the embodiment of the pressure booster 16 shown in FIG. 6, the connection of the reservoir chamber 48 extends to the control chamber 52, via the on-off valve 26 embodied preferably as a 3/2-way valve. This valve closes the low-pressure-side pressure booster return 24 in the switching position shown in FIG. 6, and upon actuation for example of an electromagnet opens it, as a result of which the control chamber 52 is pressure-relieved, the first pressure booster piston part 54 moves into the high-pressure chamber 50, and the fuel volume stored there presses into the high-pressure reservoir 18 (common rail) via the high-pressure valve 40 via the high-pressure outlet 46.

In the embodiment of the pressure booster 16 shown in FIG. 6 as well, the prestressing spring 64 and the restoring spring 34 are braced on the collar 33 of the first pressure booster piston part 54. The reservoir chamber 48, which subjects the guide body 36 to a supporting pressure exerted from outside, in order to keep the leakage quantities slight, is acted upon, analogously to the above-described embodiments of the pressure booster 16, by the high-pressure pump 14 via the pressure booster inlet 44 (compare the illustration in FIG. 1).

The foregoing relates to the preferred exemplary embodiments of the invention, it being understood that other variants and embodiments thereof are possible within the spirit and scope of the invention, the latter being defined by the appended claims.

The invention claimed is:

1. A pressure boosting system for at least one fuel injector of a high-pressure injection system of an internal combustion engine, having a hydraulic pressure booster that is actuated by an on-off valve and which is embodied with a pressure booster piston, the pressure booster piston having a first pressure booster piston part with a first diameter and a second pressure booster piston part with a second different diameter, the first diameter being larger than the second diameter, and a high-pressure chamber acted on by one pressure booster piston part and a control chamber acted on by the other pressure booster piston part, the pressure booster piston being disposed inside a hydraulic reservoir chamber, with the first pressure booster piston part having a larger diameter being subjected to pressure and embodied inside a base body, wherein the base body has a piston guide body for at least one of the first pressure booster piston part and the second pressure booster piston parts, and the piston guide body is at least partly surrounded by an annular chamber which is part of the hydraulic reservoir chamber.

2. The pressure boosting system as defined by claim 1, wherein the first pressure booster piston part having the larger diameter acts upon the high-pressure chamber provided for pressure boosting, and the second pressure booster piston part having a smaller diameter acts upon the control chamber, and the first pressure booster piston part having the larger diameter adjoins the hydraulic reservoir chamber.

3. The pressure boosting system as defined by claim 2, wherein the high-pressure chamber is disposed inside the piston guide body.

4. The pressure boosting system as defined by claim 2, wherein the high-pressure chamber is defined by a spring-impinged high-pressure sleeve, which is guided axially movably on the pressure booster piston and is positioned against the piston guide body at a sealing point.

5. The pressure boosting system as defined by claim 4, wherein a diameter of the sealing point is less than or equal to the diameter of the first pressure booster piston part of the pressure booster piston.

6. The pressure boosting system as defined by claim 2, wherein the control chamber of the pressure booster is embodied inside the piston guide body and is subjected to pressure by the second pressure booster piston part of the pressure booster piston.

7. The pressure boosting system as defined by claim 3, wherein the control chamber of the pressure booster is embodied inside the piston guide body and is subjected to pressure by the second pressure booster piston part of the pressure booster piston.

8. The pressure boosting system as defined by claim 4, wherein the control chamber of the pressure booster is embodied inside the piston guide body and is subjected to pressure by the second pressure booster piston part of the pressure booster piston.

9. The pressure boosting system as defined by claim 1, wherein the second pressure booster piston part having a smaller diameter than the first pressure booster piston part acts upon the high-pressure chamber provided for the pressure boosting, and the first pressure booster piston part having the larger diameter acts upon the control chamber, the high-pressure chamber is embodied inside the piston guide body, and the control chamber, upon which the pressure booster piston part having the larger diameter acts, adjoins the reservoir chamber.

10. The pressure boosting system as defined by claim 1, wherein a filling line is provided, which branches off from the hydraulic reservoir chamber and by way of which the control chamber and/or the high-pressure chamber is refilled after a pressure boosting phase.

11. The pressure boosting system as defined by claim 2, wherein a filling line is provided, which branches off from the hydraulic reservoir chamber and by way of which the control chamber and/or the high-pressure chamber is refilled after a pressure boosting phase.

12. The pressure boosting system as defined by claim 3, wherein a filling line is provided, which branches off from the hydraulic reservoir chamber and by way of which the control chamber and/or the high-pressure chamber is refilled after a pressure boosting phase.

13. The pressure boosting system as defined by claim 1, wherein the pressure booster is provided centrally for a plurality of fuel injectors and is disposed between a high-pressure pump and a high-pressure reservoir.

14. The pressure boosting system as defined by claim 2, wherein the pressure booster is provided centrally for a plurality of fuel injectors and is disposed between a high-pressure pump and a high-pressure reservoir.

15. The pressure boosting system as defined by claim 12, wherein the pressure booster is provided centrally for a plurality of fuel injectors and is disposed between a high-pressure pump and a high-pressure reservoir.

16. The pressure boosting system as defined by claim 1, wherein the pressure booster is inactive at pressures below a maximum supply pressure of the high-pressure pump, and the maximum supply pressure of the high-pressure pump acts upon the high-pressure reservoir via the reservoir chamber, a filling valve, and a high-pressure outlet.

17. The pressure boosting system as defined by claim 2, wherein the pressure booster is inactive at pressures below a maximum supply pressure of the high-pressure pump, and the maximum supply pressure of the high-pressure pump acts upon the high-pressure reservoir via the reservoir chamber, a filling valve, and a high-pressure outlet.

18. The pressure boosting system as defined by claim 15, wherein the pressure booster is inactive at pressures below a maximum supply pressure of the high-pressure pump, and the maximum supply pressure of the high-pressure pump acts upon the high-pressure reservoir via the reservoir chamber, a filling valve, and a high-pressure outlet.

19. The pressure boosting system as defined by claim 1, wherein the pressure booster is activated when fuels are supplied at above a maximum supply pressure, and its control chamber communicates for pressure relief with a pressure booster return via the on-off valve.

20. The pressure boosting system as defined by claim 18, wherein the pressure booster is activated when fuels are supplied at above the maximum supply pressure, and its control chamber communicates for pressure relief with a pressure booster return via the on-off valve.

* * * * *